United States Patent [19]

Cloutier et al.

[11] Patent Number: 4,509,659

[45] Date of Patent: Apr. 9, 1985

[54] PORTABLE LIQUID MEASURING AND DISPENSING DEVICE

[76] Inventors: Richard Cloutier, 23 Langevin St., Boisbriand, Quebec, Canada, J7E 4H5; Carlo Vissani, 9885 Larose St., Montreal, Quebec, Canada, H2B 2Y7

[21] Appl. No.: 415,900

[22] Filed: Sep. 8, 1982

[51] Int. Cl.[3] ..... B67D 5/30

[52] U.S. Cl. ..... 222/41; 222/110; 222/318; 222/333; 222/372; 222/380; 222/444; 137/571; 137/576; 137/605; 184/7.4

[58] Field of Search ..... 222/282, 372, 318, 444, 222/305, 306, 424, 333, 383, 154, 158, 14, 23, 40, 109, 380, 424.5, 129, 144.5, 110, 309, 310, 41, 388; 417/234; 60/413; 184/7 D, 7 L, 7 LR, 7 E, 15.1; 137/565, 571, 576, 605, 606

[56] References Cited

U.S. PATENT DOCUMENTS

| | | | |
|---|---|---|---|
| 1,081,817 | 12/1913 | Deming | 417/234 X |
| 2,066,030 | 12/1936 | Clark | 222/372 X |
| 2,995,213 | 8/1961 | Gross . | |
| 3,179,099 | 4/1965 | Alt et al. | 137/565 X |
| 3,191,719 | 6/1965 | Waddell et al. . | |
| 3,481,318 | 12/1969 | Sparrow et al. . | |
| 3,642,098 | 2/1972 | Fomin . | |
| 3,739,953 | 6/1973 | Cretors | 222/318 |
| 3,760,981 | 9/1973 | Weed | 222/318 X |
| 4,004,862 | 1/1977 | Hill | 417/234 |
| 4,286,691 | 9/1981 | Stong | 184/7 CR |

*Primary Examiner*—Joseph J. Rolla
*Assistant Examiner*—Kevin P. Shaver
*Attorney, Agent, or Firm*—Robic, Robic & Associates

[57] ABSTRACT

Portable liquid measuring and dispensing device comprising a main reservoir for containing oil and to which a chamber is connected for metering a predetermined quantity of oil, this chamber being solid with the main reservoir and having a visual indicator showing the quantity of liquid contained in the chamber. The device includes a liquid moving assembly solid with the reservoir and the chamber, this assembly being formed of a rotary pump brought into rotation by a D.C. motor connected to a power source including a polarity inverter switch having a pair of buttons, each actuatable to cause rotation of the pump in one of its two directions of rotation. A piping installation operatively connects the reservoir, the pump, the chamber and the dispenser to allow movement of the liquid restrictively from the reservoir through the pump to the chamber when one of the buttons is actuated and the pump rotates in one of the directions, and to allow movement of the liquid restrictively from the chamber through the pump to the dispenser when the other one of the buttons is actuated and the pump rotates in the other direction.

5 Claims, 4 Drawing Figures

PORTABLE LIQUID MEASURING AND DISPENSING DEVICE

The present invention relates to a portable liquid measuring and dispensing device.

As is known, most two-stroke engines used particularly for light motorcycles, lawn mowers, chain saws and the like operate on a mixture of gasoline and oil. The preparation of such a mixture in a given ratio of oil to gasoline is generally difficult to carry out, especially when the requested oil and gasoline mixture varies within a wide range from one engine to the other.

We are aware that there presently exists a large number of systems which dispense measured amounts of oil to a use station for the purpose of lubricating a given machine. Some of them are also portable but usually quite complicated and consequently costly as well as expensive.

An object of our invention is therefore to propose a liquid measuring and dispensing device which is formed as an integrated assembly and is portable while providing a precise possibility of dispensing an accurate metered quantity of liquid, such as oil which can then be mixed with the gasoline to provide the proper oil to gasoline ratio.

More specifically and in accordance with the broad aspect of the invention, there is provided and claimed herein a portable liquid measuring and dispensing device which comprises a main reservoir for containing the liquid; chamber means for metering predetermined quantities of the liquid, this chamber means being solid with the main reservoir and including a chamber having a visual means capable of indicating the quantity of liquid in the chamber, and a liquid moving assembly, likewise solid with the reservoir and chamber means. This assembly comprises: a rotary pump; a D.C. motor connected to the pump for operation in either one of its two opposed directions of rotation; D.C. power source means connected to the motor and including a polarity inverter switch having operating button means actuatable to cause selective rotation of the motor in one of its two directions of rotation; a liquid dispenser, and piping means. The latter piping means operatively connect the reservoir, the pump, the chamber and the dispenser in such a manner as to allow movement of the liquid restrictively from the reservoir to the pump to the chamber when the button means are actuated for the motor to rotate in one direction and to allow movement of the liquid restrictively from the chamber through the pump to the dispenser when the button means are actuated for rotation of the motor in the other direction.

As will be gathered from the above description, the portable device while being of particular interest in delivering oil for gasoline-oil mixtures, may be used for dispensing any liquids in precise metered quantities.

In a particularly interesting embodiment of our invention, the chamber has a liquid aperture to which the piping means is connected and the chamber means further comprises a movable piston closing one end of the chamber while resilient means biases the piston toward the liquid aperture. The chamber may also be constructed so that its wall, facing the piston, be in common with a portion of the wall of the reservoir, a valve assembly being provided on the said common wall, which valve assembly is operable from outside the reservoir for closing and opening communication between the reservoir and the chamber and may thus serve to transfer excess of liquid or air that may have been pumped into the chamber.

Other objects and features of our invention will become apparent from the description that follows of a preferred embodiment thereof having reference to the appended drawings wherein.

Figure 1:
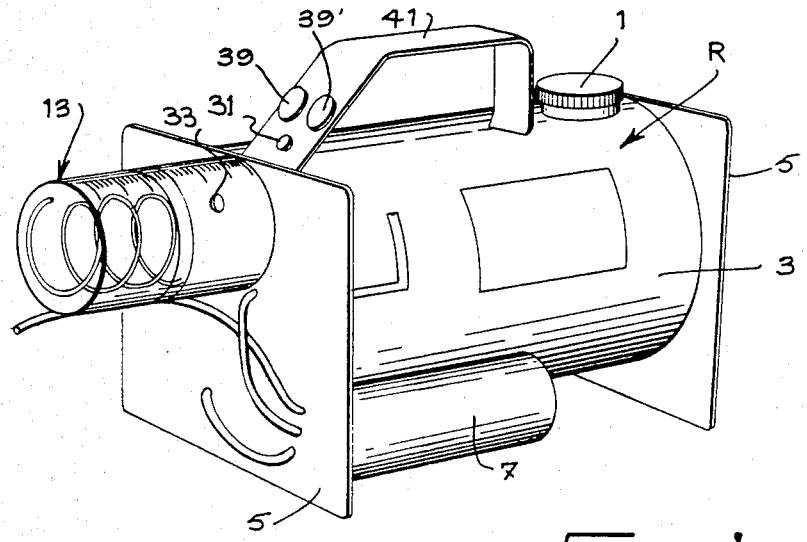
FIG. 1 is a perspective view of a portable liquid measuring and dispensing device made according to our invention.

As shown in the drawing, the device of our invention comprises a main reservoir R into which the oil is received through a removable dip stick cap 1 preferably provided with some type of vent means although the latter may be provided elsewhere on the reservoir.

Figure 2:
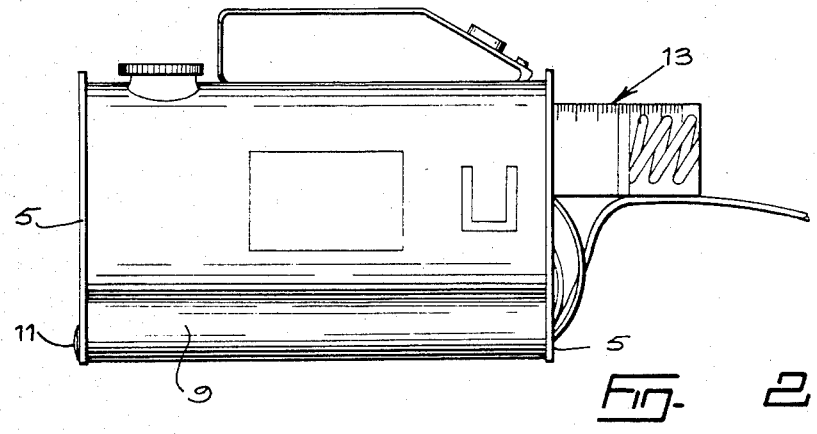
FIG. 2 is a side elevation of the device of FIG. 1.
Figure 3:
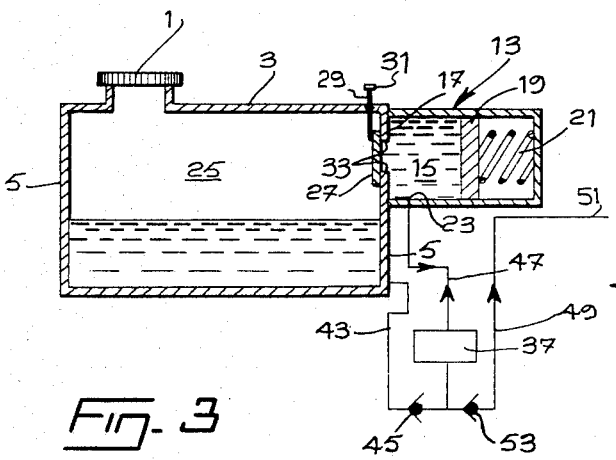
FIG. 3 is a longitudinal cross-sectional view of the device of FIGS. 1 and 2.
Figure 4:
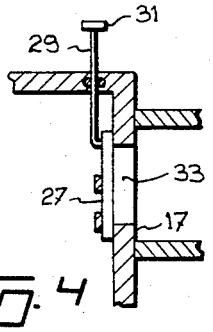
FIG. 4 is an enlarged view of the circled portion of FIG. 3.

The reservoir is made up of a horizontal main cylindrical body 3 closed at the ends by cheek plates 5 which, as clearly illustrated in FIG. 1, may generally be rectangular in shape, having the top slightly rounded for esthetic purposes. Such plates 5 advantageously laterally project beyond the circumference of the ends of the cylindrical body 3 to thereby provide protected areas on either side thereof for the mounting of a pump assembly 7, on one side (FIG. 1) and a cylinder 9, on the other side (FIG. 2) secured between the two cheek plates 5 and intended to receive batteries for the operation of the pump assembly 7. Access to within the battery cylinder 9 is made possible by the provision of a screwed cap 11.

Mounted on the front cheek plate 5 with its axis parallel to the axis of the cylindrical body 3, is a chamber assembly 13 defining a cylindrical chamber 15 which has one wall 17 in common with the front cheek plate 5 of the reservoir R and an opposite wall in the form of a piston 19 slidable sealingly within the chamber 15 and resiliently biased toward the wall 17 by a spring 21. Access to the chamber 15 for the ingress and egress of oil is through an aperture 23 located close to chamber wall 17.

Manually operable valve means of any known type provides communication between the metering chamber 15 and the reservoir chamber 25. This may be in the form of a flat gate 27 provided with an operating stem 29 extending through the cylindrical body 3 and operable from outside thereof by means of a knob 31. As will easily be gathered, lifting of the gate 27 will free an opening 33 located in the upper end of the wall 17 while lowering of the gate 27 will of course close it.

Oil is moved from the reservoir chamber 25 to the metering chamber 15 by means of an oil moving assembly solid with the reservoir R and the chamber means 15. This oil moving assembly comprises a gear pump 37, of the aforesaid pump assembly 7, driven by a D.C. motor (not shown) connected to the pump 37 for operation in either one of the two opposite directions of rotation. The assembly further includes a D.C. power source means including the batteries of the cylinder 9 which are connected to the not shown motor through an electrical circuit including a polarity converter switch of any known type having a pair of buttons 39, 39' (FIG. 1) each actuatable to cause rotation of the motor and pump in one of the two directions of rotation.

Piping means operatively connect, as aforesaid, the reservoir R, the pump 37, the chamber 15 and a dispenser to allow movement of the oil restrictively from the reservoir through the pump 37 to the chamber 15 when one of the buttons 39, 39' is actuated and the pump rotates in one of the directions of rotation and to allow movement of the oil restrictively from the chamber 15 through the pump 37 to the oil dispenser when the other one of the buttons is actuated and the pump 37 rotates in the other direction. Such piping means, as shown, comprises a first pipe branch 43 joining the reservoir chamber 25 and the inlet of the pump 37, having a check valve 45 mounted across it to allow liquid flow only from the reservoir chamber 25 to the pump inlet. The piping means further includes a second pipe branch 47 joining the outlet of the pump 37 and the chamber 15 through the aperture 23. Finally, the piping means includes a third pipe branch 49 joining the inlet of the pump 37 and the liquid dispenser which may merely be the open free end of this third pipe branch. Dispenser 51 may also be in the form of a conical nozzle or the like. The third pipe branch 49 includes a check valve 53 which prevents air from being sucked into the pump 37 from the dispenser 51.

As said previously, our invention includes visual means capable of indicating the quantity of liquid metered in the chamber 15. This visual means may comprise a portion at least of the cylindrical body making up the chamber 15 being made of transparent material and carrying a measuring scale, the periphery of the forward face of the piston 19 then cooperating with the measuring scale to indicate the amount of liquid in the chamber 15.

The operation of the portable oil measuring and dispensing device of our invention operates as follows.

Whenever a predetermined quantity of oil is required, the proper one of the push buttons 39, 39' is depressed to energize the motor driving the pump 37 which then, by rotating in the proper direction, draws oil from the reservoir chamber 25, through the first pipe branch 43 and its check valve 45 and pumps it into the chamber 15 through the second pipe branch, pushing the piston rightward against the bias of the spring 21. When the periphery of the front face of the piston 19 reaches the proper indication on the scale, corresponding to the quantity of oil required, the button 39 or 39' is released. If too much oil or some air has entered into the chamber 15, then the gate 27 is lifted slightly to allow some of the oil in chamber 15 to return to the reservoir chamber 25, this action being helped by leftward movement of the piston 19 under the bias of the spring 21.

Dispensing of the liquid in the chamber 15 is obtained by depressing the other of the push buttons 39, 39' which then causes rotation of the motor and pump 37 in the other direction thereby drawing oil from the chamber 15, through the second pipe branch 47 and pump 37 and finally through the third pipe branch 49 and dispenser 51. No oil is then driven back into the reservoir chamber 25 because of the presence of the check valve 45 across the first pipe branch 43.

It will thus be appreciated from the above description that we have provided a portable liquid measuring and dispensing device which is extremely simple in construction, easy to manufacture at a low cost and very simple in operation. Furthermore, all the major components such as the pump assembly, the batteries and the polarity converter switch are easily available on the market thereby rendering the construction of the device simpler and inexpensive.

We claim:

1. A portable liquid measuring and dispensing device comprising:

a main reservoir for containing said liquid;

chamber means for metering predetermined quantities of said liquid, said chamber means being solid with said main reservoir and comprising a chamber having visual means capable of indicating the quantity of liquid therein, said chamber also having a liquid aperture, said chamber means further comprising a movable piston closing one end of said chamber and resilient means biassing said piston toward said liquid aperture, a liquid moving assembly solid with said reservoir and chamber means, said assembly comprising:

a rotary pump;

a D.C. motor connected to said pump for operation thereof in either one of two opposed directions of rotation;

D.C. power source means connected to said motor and including a polarity inverter switch having operating button means actuatable to cause selective rotation of said pump in one of said directions;

a liquid dispenser, and piping means operatively connecting said reservoir pump, chamber, reservoir and dispenser to allow movement of said liquid restritively from said reservoir through said pump to said chamber when the button means are actuated for rotation of the motor in one of said directions and to allow movement of said liquid restrictively from said chamber through said pump to said dispenser when the button means are actuated for rotation of the motor in the other of said directions.

2. A device as claimed in claim 1, wherein said chamber has a wall, facing said piston, in common with a portion of the wall of said main reservoir, and including valve means, operable from outside said reservoir, for closing and opening communication between said reservoir and said chamber.

3. A device as claimed in claim 2, wherein said piping means comprises:

a first pipe branch joining said reservoir and the inlet of said pump, and a check valve mounted across said first branch to allow liquid flow only from said reservoir to said pump inlet;

a second pipe branch joining the outlet of said pump and said chamber through said liquid aperture, and a third pipe branch joining the inlet of said pump and said liquid dispenser, and a check valve mounted across said third branch to prevent air from being sucked into said pump from said dispenser.

4. A device as claimed in claim 3, wherein said dispenser is the outer free end of said third pipe branch.

5. A device as claimed in claim 1 or 2, wherein said visual means comprises a portion at least of said chamber being made of transparent material and carrying a measuring scale; and wherein the periphery of said piston cooperates with said measuring scale to indicate the amount of liquid in said chamber.

* * * * *